United States Patent [19]

Hayashi et al.

[11] 4,316,607

[45] Feb. 23, 1982

[54] PAPERBOARD FEEDING APPARATUS

[75] Inventors: Masaharu Hayashi, Omiya; Kouichi Ueda, Iwatsuki, both of Japan

[73] Assignee: Kabushiki Kaisha Tomoku, Otaru, Japan

[21] Appl. No.: 127,965

[22] Filed: Mar. 7, 1980

[30] Foreign Application Priority Data

Mar. 12, 1979 [JP] Japan ..... 54-30441[U]

[51] Int. Cl.[3] ..... B65H 1/14

[52] U.S. Cl. ..... 271/151; 271/3.1; 271/154; 271/34; 318/773

[58] Field of Search ..... 271/3.1, 151, 150, 149, 271/162, 155, 157, 154, 153, 152, 34, 35; 414/33, 118; 318/773; 198/592

[56] References Cited

U.S. PATENT DOCUMENTS

| | | | |
|---|---|---|---|
| 2,393,998 | 2/1946 | Mahnke | 318/773 X |
| 3,221,233 | 11/1965 | Cantonwine | 318/773 |
| 3,239,944 | 3/1966 | Gebert | 271/210 X |
| 3,558,127 | 1/1971 | Blewitt | 271/155 |
| 4,042,234 | 8/1977 | Tokuno | 271/151 |

*Primary Examiner*—Bruce H. Stoner, Jr.
*Attorney, Agent, or Firm*—Haseltine and Lake

[57] ABSTRACT

An improved paperboard feeding machine has a tiltable lift, a lifting yoke provided on the lift and arranged for operation by respective electric motors for the lift and the yoke. Each of the motors is responsive to change in the effective number of the poles in each of the motors.

1 Claim, 6 Drawing Figures

PAPERBOARD FEEDING APPARATUS

BACKGROUND OF THE INVENTION

The present invention relates to a paperboard feeding apparatus used primarily for the feeding of corrugated paperboards to a further work station in a box manufacturing process line.

In conventional paperboard feeding machines of the type known in the prior art, it has proven difficult to feed stacked corrugated cardboards, one by one, or, group by group, into a box manufacturing process line in a fashion which is both fluid and reliable. Accordingly, this invention has its object the provision of a paperboard feeding machine which is free of the above shortcomings.

SUMMARY OF THE INVENTION

The present invention provides an improved paperboard feeding machine having a tiltable lift and a lifting yoke provided upon said lift, said lift and said yoke each being arranged for operation by two corresponding motors in which the improvement of the present invention comprises means for change of the effective pole number of both of the respective motors for said lift and said yoke.

DETAILED DESCRIPTON OF THE INVENTION

Figure 1:
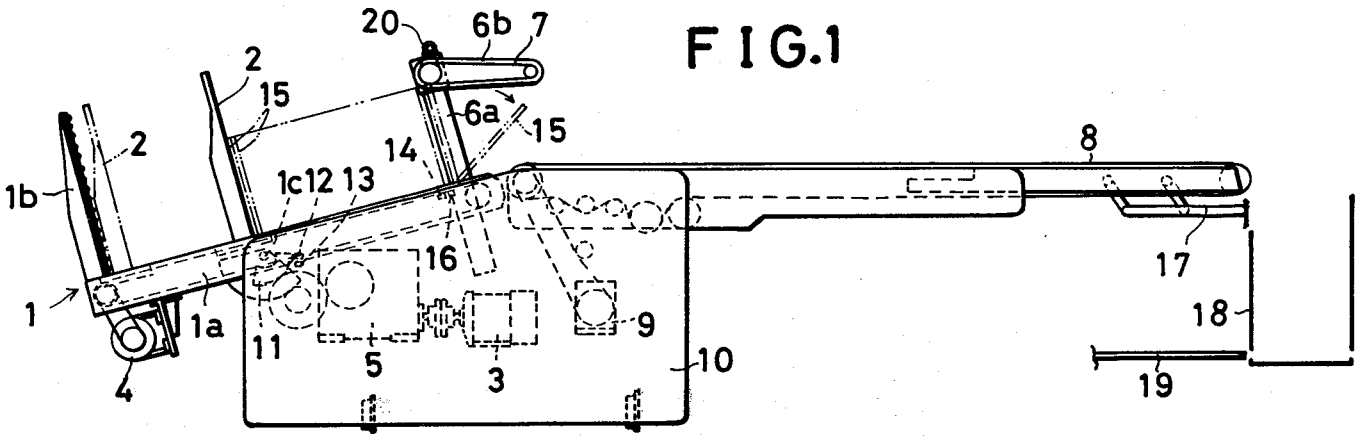
FIG. 1 is a side view of a first embodiment of the present invention, shown in its operative condition.
Figure 2:
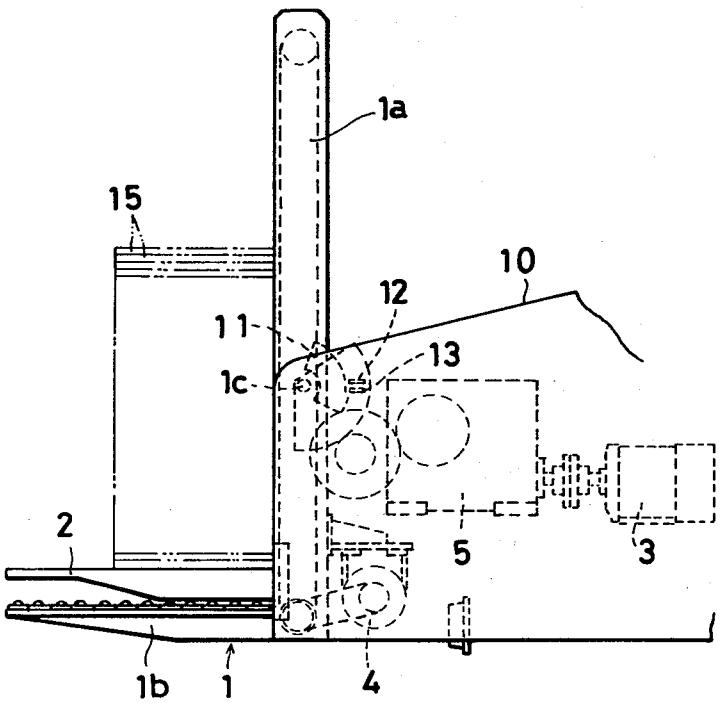
FIG. 2 is a side view of a pertinent portion of said first embodiment at a time prior to initiation of supply, to the general system, of the corrugated paperboards.

With reference to FIGS. 1 and 2, element 1 comprises a tiltable lift having a vertical part 1*a* and a horizontal part 1*b*. The lift is rotatably supported by a shaft 1*c*. Element 2 denotes a lifting yoke which is so provided as to be movable upwards and downwards along the said vertical part 1*a*. Element 3 denotes an electric motor for driving the tiltable lift 1; element 4 denotes an electric motor for driving the lifting yoke 2. Element 5 denotes a reduction gear provided on the output side of the motor 3, and elements 6*a* and 6*b* denote lower and upper supporting arms of a carrying belt 7 for forwardly bringing-down stacked cardboards 15. The lower arm 6*a* is located on the lateral outside of the lift 1 and is supported on the machine body so as to be movable upwards and downwards while the upper arm 66 extends horizontally and carries the belt 7 thereon.

Element 8 denotes a conveyor belt provided ahead of the tiltable lift 1; element 9 denotes a change of speed gear in connection with a motor for driving the conveyor belt 8. Element 10 denotes a machine side wall supporting the tiltable lift 1 and other elements. Element 11 denotes a segment cam arranged to be turned with the turning of the tiltable lift 1. Elements 12 and 13 denote first and second limit switches arranged to be actuated by the segment cam 11. Elements 14 and 16 denote third and fourth limit switches provided on the tiltable lift 1 and arranged to be actuated by a stack of corrugated cardboards 15. Element 17 denotes a push-and-alignment member while element 18 denotes a feeding hopper. Element 19 denotes a kick plate, and element 20 denotes an electric motor for driving the belt 7.

Both the electric motor 3 for driving the tiltable lift 1, and the electric motor 4 for driving the lifting yoke 2, are induction motors of the type whose synchronous speed can be changed by changing the effective number of the poles of the windings thereof, the same generally being known as a pole change motor.

The motor 3 may, for instance, have a pole number ratio of 4 to 8; and the motor 4 may, for instance, have a pole number ratio of 4 to 32.

Next, the operation of the present inventive apparatus is explained as follows:

Firstly, the tiltable lift 1 is set in such an upright posture that, as shown in FIG. 2, the horizontal part 1*b* thereof and, accordingly, the lifting yoke 2 is in its horizontal position. Thus, a large number of corrugated cardboards obtained, after completion of a preceding step, are conveyed to and loaded on the lifting yoke 2 in a piled-up state by a roller conveyor (not illustrated). The cardboards are illustrated in dotted line in FIG. 2.

Figure 3C:
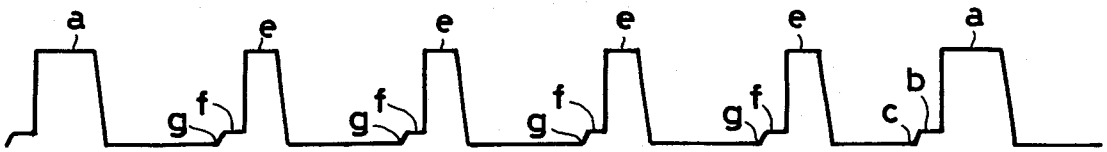
FIGS. 3(A), 3(B), and 3(C) are time versus velocity graphs illustrating the rotational modes corresponding to the change of pole numbers.
Figure 3B:
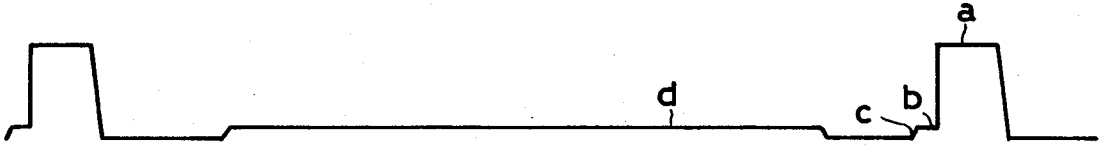
Figure 3A:
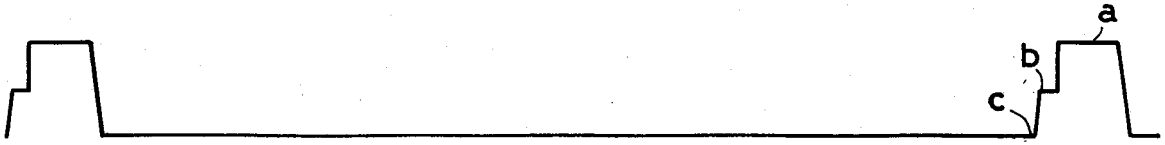
Figure 4:
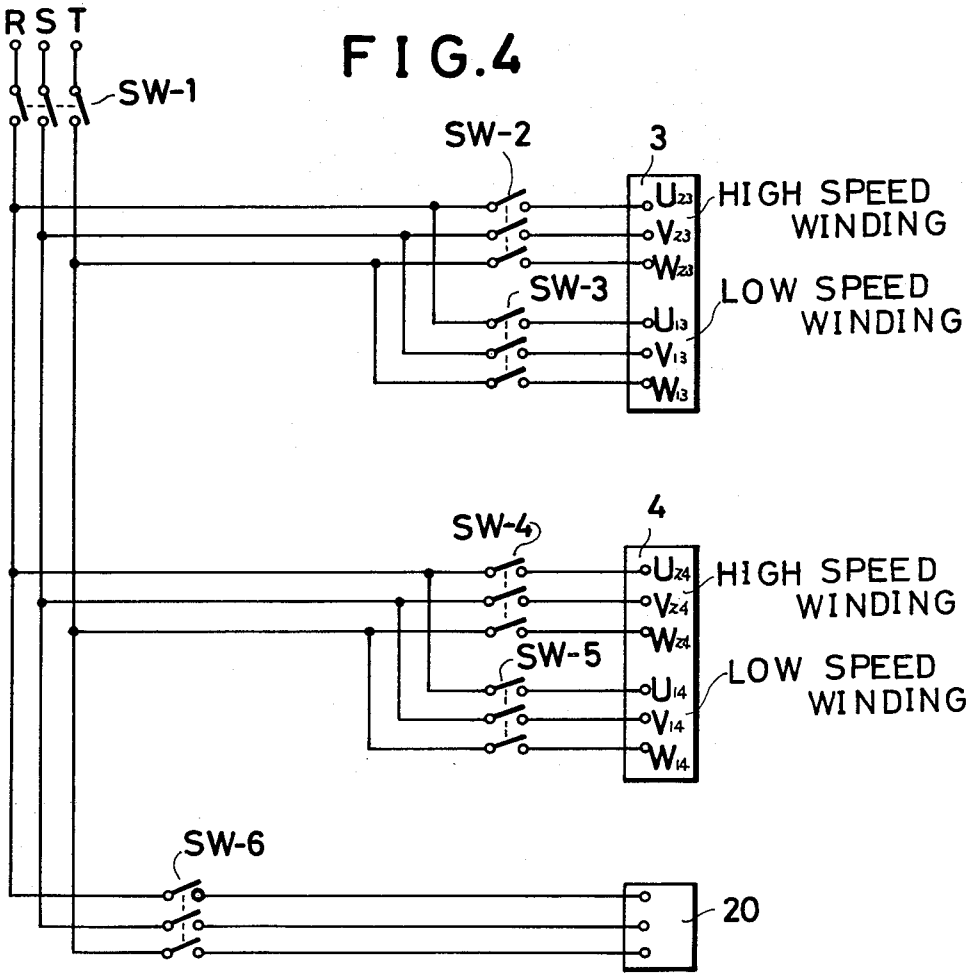
FIG. 4 is a circuit diagram illustrating the control means for the lift and yoke motors.

Next, a power switch SW-1, shown in FIG. 4, is closed and additionally a switch SW-2 is closed and, thereby, a high speed side winding of the motor 3, e.g., a winding of four poles (terminals $U_{23}$, $V_{23}$, $W_{23}$) of the motor 3 is connected to a power source (R, S, T) so that the motor 3 is rotated at a high speed and, consequently, the tiltable lift 1 is turned, that is, tilted to the right at a high speed. See Step "a" of FIG. 3A.

When the tiltable lift 1 reaches an angular position which is just before an angular position of 15 degrees in relation to the horizontal plane, the first limit switch 12, which is disposed to face the segment cam 11, is turned with the turning of the tiltable lift 1 and is operated by the cam 11, whereby the switch SW-2 is opened and at the same time a switch SW-3 is closed. Thereby, a low speed side winding of the motor 3, e.g., a winding of eight poles (terminals $U_{13}$, $V_{13}$, $W_{13}$) of the motor 3 is connectd to the power source (R, S, T) so that the motor 3 is changed over to rotate at a lower speed while having applied thereto a regenerative braking which is shown as Step "b" of FIG. 3A. Thereafter, the second limit switch 13 is operated in which the switch SW-3 is opened and, concurrently, an electromagnetic braking of the motor 3 is accomplished, so that the tiltable lift 1 is stopped gently and definitely at a predetermined position shown in FIG. 1. See Step "c" of FIG 3A.

If, thereafter, a switch SW-4, interposed in a circuit for a high speed side-winding of the motor 4 for driving the lifting yoke 2, is closed, the high speed side-winding of the motor 4, that is, a winding of eight poles (terminals $U_{24}$, $V_{24}$, $W_{24}$) of the motor 4 will be connected to the power source (R, S, T). Therein, the motor 4 will be rotated at a higher speed (Step "a" of FIG. 3B), so that the lifting yoke 2 is moved to the right (in the drawings) at a higher speed from a position shown by the double-dotted lines in FIG. 1. When the same reaches a position which is just before the position shown in solid lines in FIG. 1, the third limit switch 14 is activated by the front end of the stacked corrugated cardboards 15 set on edge. The switch SW-4 is opened and switch SW-5 is closed. Thereby, a low speed side-winding of the motor 4, that is, a winding of thirty-two poles (terminals $U_{14}$, $V_{14}$, $W_{14}$) is connected to the power source (R, S, T) so that the motor 4 is changed to rotate at a lower speed while being slowed by the regenerative braking effect (See Step "b" of FIG. 3B). Thereafter, the fourth limit switch 16 is operated by the forward end of the stack 15, upon which the switch SW-5 is opened; thus, the motor 4 is cut-off from the power source (R, S, T) and, concurrently, the electromagnetic braking means of the motor 4 is operated; thereby, the yoke 2 is stopped gently and at a predetermined position at which the corrugated cardboards 14 are, at their forward end portions, brought into proper contact with the belt 7. See Step "c" of FIG. 3B. Consequently, the corrugated cardboards 15, which are conveyed by the lifting yoke 2, are protected from a downward and/or forward shock as they are stopped.

Thereafter, by signal from a timer means, the switch SW-5 is closed again, so that the low speed side-winding of the motor 4, i.e., the winding of 32 poles (terminals $U_{14}$, $V_{14}$, $W_{14}$), is connected to the power source (R, S, T) for operation of the motor 4 at a lower speed (Step "d" in FIG. 3B), and at the same time a switch SW-6 for the motor 20 and a further switch for the change of speed gear 9 (not illustrated), are closed for operation of, respectively, the drive motor 20 of the belt 7 and the speed change gear 9 of the conveyer belt 8. Consequently, the stack of the corrugated cardboards 15, set on edge, are brought down and forwards (rightwards in the drawings), one by one, continuously, at the forward end thereof by the belt 7, and are carried on the conveyer belt 8 and are conveyed forwards in a laid-down and overlapped state. Thereafter, the said cardboards are dropped into the feeding hopper 18 and are piled upon one another. The resultant piled cardboards are pushed from one side by the push-and-alignment member 9 so as to be arranged in a vertical line. The aligned cardboards are then kicked-out, one by one, from the bottom by the kick plate 19 to the next box process work station.

In order that the corrugated cardboards 15 carried on the conveyer belt 8 may be formed into the overlapped condition as mentioned above, the speed of the conveyer belt 8, and that of the belt 7, must be properly set in relation to the moving speed of the lifting yoke 2. The moving speed of the lifting yoke 2 in this case (Step "d" of FIG. 3B) is equal to the lower speed rotation (Step "b" of FIG. 3B) of the motor. Thus, any additional driving circuit or winding for the motor 4 is not required and, thus, the construction thereof is simplified.

There may be considered a second embodiment of the present invention in which the belt 7 and the supporting arms 6*a* and 6*b* are omitted and, instead, the bringing-down of the corrugated cardboards 15 is carried-out by hand. In this case, the lifting yoke 2 is first driven in almost the same mode as above, that is, the motor 4 is first rotated at the higher speed and is then changed over to the lower speed, again being subjected to the regenerative braking caused by the changing of the number of poles until it is stopped. Consequently, the lifting yoke 2 is stopped gently and definitely at a predetermined position. (See Steps "a" "b" "c" of FIG. 3C). Thereafter, a forward group of the stacked corrugated cardboards 15 is brought downward and forwards by hand and is conveyed forwards by the conveyer belt 8. Thereafter, by means of a timer, the switch SW-4, interposed in the high-speed side-winding circuit of the motor 4, is closed intermittently in order to rotate the motor 4 at the higher speed (Steps "e" . . . of FIG. 3C), whereby the lifting yoke 2 is moved, at the higher speed, rightwardly and intermittently, so that the head of the remaining stacked corrugated cardboards 15 will always be at hand. In this case also, the motor 4 is stopped after being changed over to rotate at its lower speed, again with the regenerative braking, by changing the number of poles as shown by Steps "f" and "g" of FIG. 3C, in the general manner described above.

In the foregoing examples, the limit switches were used for controlling operations of the motors 3 and 4; however, such a modification can be considered in which timer means are used instead thereof. In such an embodiment, the driving circuits for the motors 3 and 4 are additionally provided with reverse rotation circuits, including reverse rotation switches, though not illustrated in FIG. 4, in order to return the tiltable lift 1 and the lifting yoke 2 to their respective original positions.

Thus, according to this invention, each of the motors for driving the tiltable lift and the motor for driving the lifting yoke include a pole change motor which is arranged to be first rotated at a higher speed and then changed-over to rotation at a lower speed, while being subjected to regenerative braking by changing of the number of the poles thereof and, thereafter, stopped, so that both the tiltable lift and the lifting yoke can be operated at the higher speed and can, when desired, be stopped gently. Consequently, stacked corrugated cardboards on the lift can be supplied at a predetermined position, smoothly and reliably, without falling as a result of shock.

Additionally, the motor for driving the lifting yoke is also used for feeding the stacked corrugated cardboards to the conveyer by operating the same, again at the lower speed, continuously, or at the higher speed, intermittently, so that an additional driving circuit for the motor is not necessary and the machine can be simply constructed.

Accordingly, while there have been shown and described the preferred embodiments of the present invention, it will be understood that the invention may be embodied otherwise than as herein specifically illustrated and described and that within said embodiments certain changes in the detail and construction, and the form of arrangement of the parts may be made departing from the underlying idea or principles of this invention within the scope of the appended claims.

Having thus described my invention what I claim as new useful and non-obvious and, accordingly, secure by Letters Patent of the United States is:

1. A cardboard feeding machine of the type having a tiltable lift (1), a lifting yoke (2) provided on the lift (1), driven conveyer belt provided ahead of the tiltable lift (1), said tiltable lift and said lifting yoke being arranged for operation by respective electric motors (3), (4), and there being provided a further belt (7) for forwardly bringing down stacked cardboard (15) over the forward end side of the tiltable lift (1), wherein: each of said motors (3), (4) is defined by a pole change motor and the motor (3) for tilting said tiltable lift (1) being so arranged as to be first rotatable at high speed and then changeable for rotation at a low speed, while being applied with regenerative braking, by changing the number of poles thereof and being stopped, circuit means including limit switches responsive to the tilted position of said tiltable lift for causing said changing of the number of poles of the tiltable lift pole change motor, said motor (4) driving the lift yoke (2) being so arranged as to first rotate at a high speed and then be changed to rotate at a low speed and thereafter being stopped when a forward end of the stacked cardboards (15) being conveyed at that low speed reaches the further belt (7), while being applied with regenerative braking, by changing the number of the poles, and being arranged to again continuously rotate at said lower speed enabling one or more of the stacked cardboards (15) to be advanced by the belt (7) one after another continuously, being conveyed in a forward direction by the conveyor belt (8) and further circuit means including limit switches responsive to the position of stacked cardboard conveyed by said lifting yoke for causing said changing of the number of poles of the lifting yoke pole change motor.

* * * * *